US007313872B1

(12) United States Patent
Nygard

(10) Patent No.: US 7,313,872 B1
(45) Date of Patent: Jan. 1, 2008

(54) BOARD ALIGNMENT TOOL AND METHOD

(76) Inventor: Thomas R. Nygard, 2802 Brookmont Dr., Effort, PA (US) 18330

( * ) Notice: Subject to any disclaimer, the term of this patent is extended or adjusted under 35 U.S.C. 154(b) by 0 days.

(21) Appl. No.: 11/479,200

(22) Filed: Jul. 3, 2006

(51) Int. Cl.
*B43L 7/10* (2006.01)

(52) U.S. Cl. ..... 33/533; 33/518; 33/465; 52/749.13

(58) Field of Classification Search ..... 33/533, 33/518, 465; 52/749.13
See application file for complete search history.

(56) References Cited

U.S. PATENT DOCUMENTS 5,096,170 A * 3/1992 Albin ..... 269/6
6,604,326 B1 * 8/2003 Noble ..... 52/749.13
2003/0071249 A1 * 4/2003 Clemons et al. ..... 254/17

* cited by examiner

*Primary Examiner*—Yaritza Guadalupe-McCall

(57) ABSTRACT

A board alignment tool includes a first plate having a bottom end and a top end. The bottom end is pointed. A second plate has a first end and a second end. The first end is pivotally coupled to the first plate. A catch is attached to the second plate adjacent to the second end. The catch extends in a substantial same direction as the bottom end when the second plate is oriented perpendicular to the first plate. The bottom end is extendable into a first board and the catch is extended into a second board. The top end is urged away from the second board and the second board pulled toward and against the first board.

7 Claims, 2 Drawing Sheets

BOARD ALIGNMENT TOOL AND METHOD

BACKGROUND OF THE INVENTION

1. Field of the Invention

The present invention relates to board alignment tools and more particularly pertains to a new board alignment tool for pulling two boards together in abutment with each other so that they may be secured in place during a framing procedure.

2. Description of the Prior Art

The use of board alignment tools is known in the prior art. While these devices fulfill their respective, particular objectives and requirements, the need remains for a device that assists a person in a quick and efficient manner to pull together a pair of boards together, and to hold them in abutment with each other, so that they may then be secured in place. This will ensure that the boards will be in proper alignment with each other when nails are used to secure their positioning.

SUMMARY OF THE INVENTION

The present invention meets the needs presented above by generally comprising a first plate having a bottom end and a top end. The bottom end is pointed. A second plate has a first end and a second end. The first end is pivotally coupled to the first plate. A catch is attached to the second plate adjacent to the second end. The catch extends in a substantial same direction as the bottom end when the second plate is orientated perpendicular to the first plate. The bottom end is extendable into a first board and the catch is extended into a second board. The top end is urged away from the second board and the second board pulled toward and against the first board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
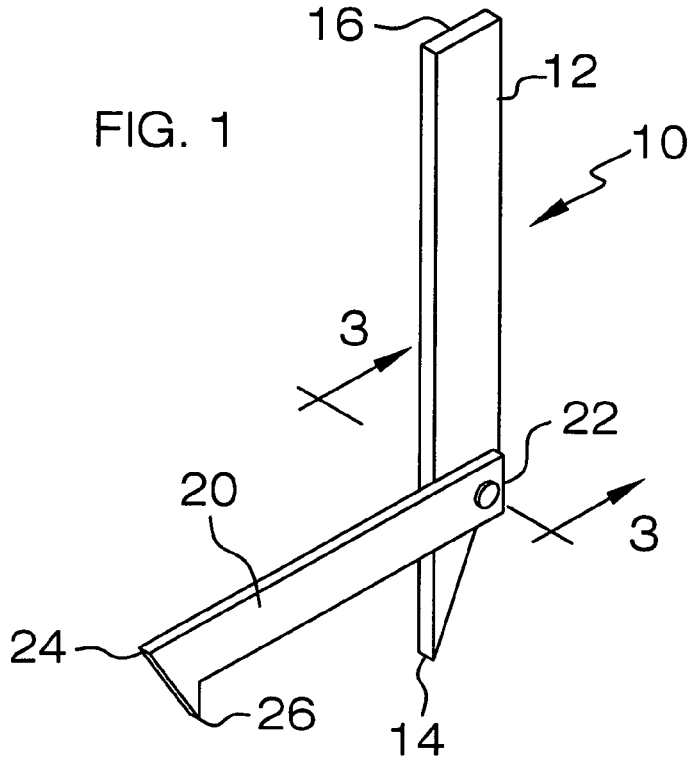
FIG. 1 is a perspective view of a board alignment tool and method according to the present invention.
Figure 2:
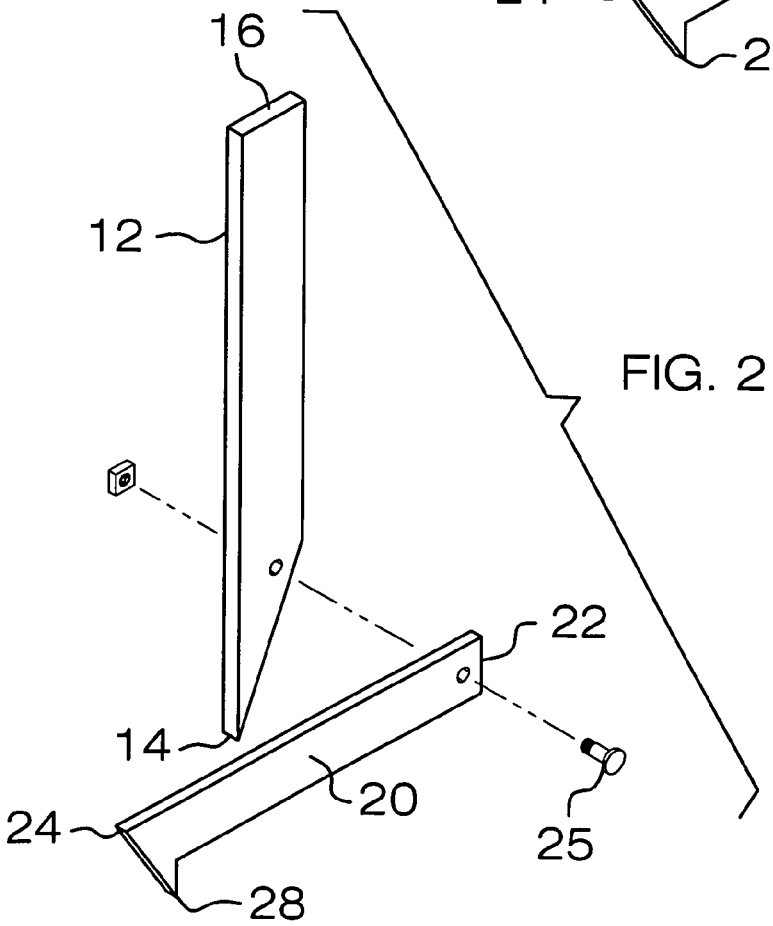
FIG. 2 is an expanded perspective view of the present invention.
Figure 3:
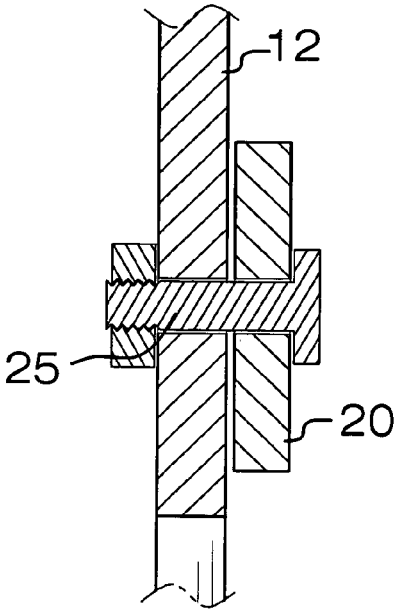
FIG. 3 is a cross-sectional view taken along line 3-3 of FIG. 1 of the present invention.
Figure 4:
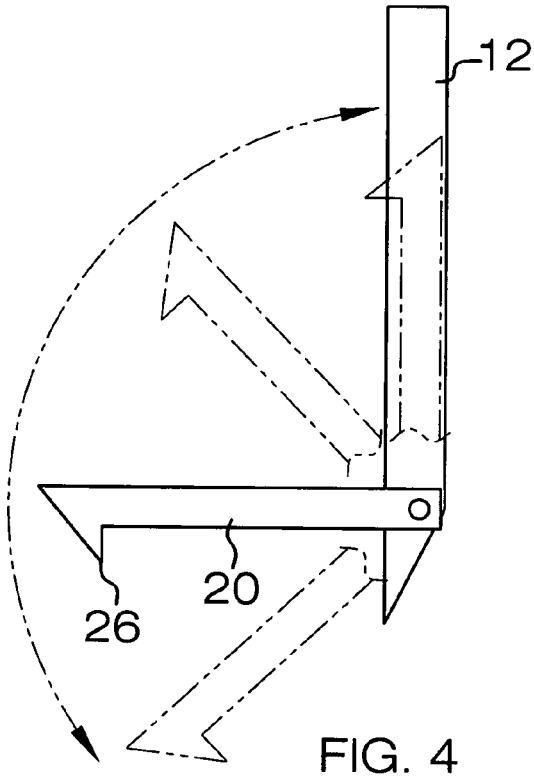
FIG. 4 is a side view of the present invention.
Figure 5:
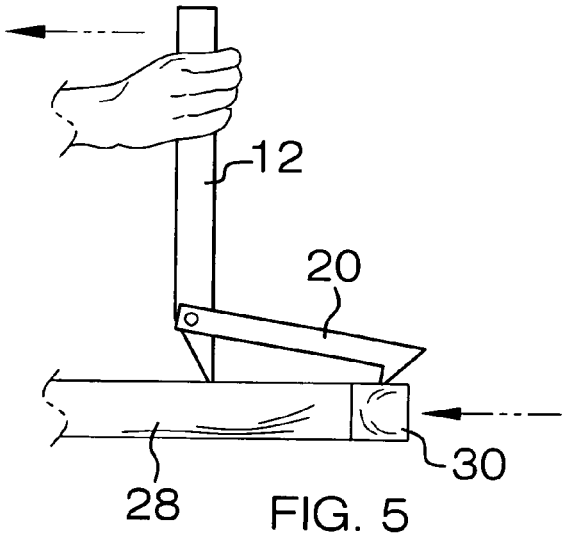
FIG. 5 is an in-use view of the present invention.

With reference now to the drawings, and in particular to FIGS. 1 through 5 thereof, a new board alignment tool embodying the principles and concepts of the present invention and generally designated by the reference numeral 10 will be described.

As best illustrated in FIGS. 1 through 5, the board alignment tool and method 10 generally comprises a first plate 12 having a bottom end 14 and a top end 16. The bottom end 14 is pointed and the first plate 12 has a height from the first top end 16 to the bottom end 14 between 8 inches and 16 inches. A second plate 20 has a first end 22 and a second end 24. The first end 22 is pivotally coupled to the first plate 12 by a pin 25. The first end 22 is positioned nearer to the bottom end 14 than the top end 16. The second plate 20 has a length between 5 inches and 10 inches from the first end 22 to the second end 24.

A catch 26 is attached to the second plate 20 adjacent to the second end 24. The catch 26 extends in a substantial same direction as the bottom end 14 when the second plate 20 is oriented perpendicular to the first plate 12. The catch 26 is preferably a pointed plate integrally coupled to the second plate 20.

A first board 28 and a second board 30 are provided. The first 28 and second 30 boards may comprise any two boards that need to be secured adjacent to each other, such as when framing a portion of a wall or window. In use, the bottom end 14 is extended into a first board 28. The top end 16 is preferably planar so that it may be struck, such as with a hammer, to assist a person in extending the bottom end 14 into the first board 28. The catch 26 is extended into the second board 30. The second plate 20 may also be struck with a hammer to drive the catch 26 into the second board 30. The top end 16 is urged, or pulled, away from the second board 30 and so that the second board 30 is pulled toward and abutted against the first board 28. Once the first 28 and second 30 boards are pulled against each other, they may be nailed in place and the tool 10 removed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A board alignment and abutting tool for pulling together and a butting a pair of boards, said tool comprising:

a first plate having a bottom end and a top end, said bottom end being pointed;

a second plate having a first end and a second end, said first end being pivotally coupled to said first plate;

a catch being attached to said second plate adjacent to said second end, said catch extending in a substantial same direction as said bottom end when said second plate is oriented perpendicular to said first plate, said bottom end of said first plate extending downwardly a distance greater than said catch when said second plate is oriented perpendicular to said first plate; and wherein said bottom end is extendable into a first board of the boards and said catch is extended into a second board of the boards, wherein said top end is urged away from the second board and the second board pulled toward and against the first board.

2. The tool according to claim 1, wherein said first plate has a height from said first top end to said bottom end between 8 inches and 16 inches.

3. The tool according to claim 2, wherein said second plate has a length between 5 inches and 10 inches from said first end to said second end.

4. The tool according to claim 1, wherein said first end is positioned nearer to said bottom end than said top end.

5. The tool according to claim 1, wherein said second plate has a length between 5 inches and 10 inches from said first end to said second end.

6. A board alignment and abutting tool for putting together and abutting a pair of boards, said tool comprising:

a first plate having a bottom end and a top end, said bottom end being pointed, said first plate having a height from said first top end to said bottom end between 8 inches and 16 inches;

a second plate having a first end and a second end, said first end being pivotally coupled to said first plate, said first end being positioned nearer to said bottom end than said top end, said second plate having a length between 5 inches and 10 inches from said first end to said second end;

a catch being attached to said second plate adjacent to said second end, said catch extending in a substantial same direction as said bottom end when said second plate is orientated perpendicular to said first plate, said bottom end of said first plate extending downwardly a distance greater than said catch when said second plate is oriented perpendicular to said first plate; and wherein said bottom end is extendable into a first board of the boards and said catch is extended into a second board of the boards, wherein said top end is urged away from the second board and the second board pulled toward and against the first board.

7. A board positioning method comprising the steps of:

providing a first plate having a bottom end and a top end, said bottom end being pointed, said first plate having a height from said first top end to said bottom end between 8 inches and 16 inches;

providing a second plate having a first end and a second end, said first end being pivotally coupled to said first plate, said first end being positioned nearer to said bottom end than said top end, said second plate having a length between 5 inches and 10 inches from said first end to said second end;

providing a catch being attached to said second plate adjacent to said second end, said catch extending in a substantial same direction as said bottom end when said second plate is orientated perpendicular to said first plate, said bottom end of said first plate extending downwardly a distance greater than said catch when said second plate is oriented perpendicular to said first plate; and providing a first board and a second board;

extending said bottom end into a first board;

extending said catch into a second board;

urging said top end away from the second board and pulling the second board pulled toward and in abutment with the first board.

* * * * *